US006644062B1

(12) United States Patent
Hays

(10) Patent No.: US 6,644,062 B1
(45) Date of Patent: Nov. 11, 2003

(54) TRANSCRITICAL TURBINE AND METHOD OF OPERATION

(75) Inventor: Lance G. Hays, Placentia, CA (US)

(73) Assignee: Energent Corporation, Santa Ana, CA (US)

( * ) Notice: Subject to any disclaimer, the term of this patent is extended or adjusted under 35 U.S.C. 154(b) by 0 days.

(21) Appl. No.: 10/270,468

(22) Filed: Oct. 15, 2002

(51) Int. Cl.[7] ..... F25D 9/00; F25B 1/00; F25B 9/00

(52) U.S. Cl. ..... 62/402; 62/498; 62/467; 62/87

(58) Field of Search ..... 62/401, 402, 498, 62/467, 87, 116

(56) References Cited

U.S. PATENT DOCUMENTS 3,971,211 A * 7/1976 Wethe et al. ..... 60/39.181
4,169,361 A * 10/1979 Baldus ..... 62/402
4,170,116 A * 10/1979 Williams ..... 62/116
4,235,079 A * 11/1980 Masser ..... 62/87
5,038,583 A * 8/1991 Gali ..... 62/498
5,467,613 A * 11/1995 Brasz ..... 62/402
5,682,759 A * 11/1997 Hays ..... 62/402
5,884,498 A * 3/1999 Kishimoto et al. ..... 62/228.1
5,996,355 A * 12/1999 Jirnov et al. ..... 62/87
6,418,747 B1 * 7/2002 Mullen et al. ..... 62/434

* cited by examiner

*Primary Examiner*—William C. Doerrler
(74) *Attorney, Agent, or Firm*—William V. Haefliger

(57) ABSTRACT

A process employing a rotary axial turbine, and a nozzle, that includes providing a working fluid expansible from a characteristic supercritical region into the wet region, expanding the fluid from said supercritical region into the wet region via the nozzle and turbine blades, and providing an output shaft driven by the turbine.

19 Claims, 6 Drawing Sheets

TRANSCRITICAL TURBINE AND METHOD OF OPERATION

BACKGROUND OF THE INVENTION

This invention relates generally to refrigeration cycle efficiency, and more particularly to recovery of energy in a process where a gas is expanded from a supercritical region into a wet region of the cycle.

The need for refrigeration systems using environmentally benign refrigerants has become greater in the last decade because of the dual drivers of ozone depletion and global warming. "Optimal" refrigerants that were engineered to maximize the cycle efficiency by minimizing the expansion throttling loss are no longer usable. The major air conditioning manufacturers have adopted refrigerants which either have a high vapor pressure and hence throttle loss (R-134A), or which have partial ozone depletion potential and high toxicity level (40 ppm Allowable Exposure Limit) and are due to be phased out (HFC-123).

The choice of $CO_2$ as a refrigerant has many benefits. It is a natural, non-toxic substance with no ozone depletion potential. Additionally, there are volumetric and heat transfer advantages and the refrigerant has a low cost. A disadvantage is that the high pressure difference for compression and expansion result in a high throttling loss, leading to a poor cycle efficiency compared to current HCFC refrigerants.

However, a supercritical $CO_2$ refrigeration cycle with an expander was found to have the same or better performance as an HCFC cycle with expansion valve. The gain in $CO_2$ refrigerant cycle efficiency resulting from energy recovery with a 60% efficient expander was as much as 33% compared to a $CO_2$ cycle with a throttling valve, and 25% compared to the same throttling valve cycle with maximum internal heat exchange.

The need for an expander to recover energy from the expansion is clearly indicated if the $CO_2$ refrigeration cycle is to be widely deployed. However, the expansion, which starts in the supercritical region, enters the two-phase region, producing over 50% liquid. by mass.

No practical expanders have been developed for this range of operation from the supercritical region into the saturation region (transcritical expansion). Attempts to use radial inflow machines in the wet region have not been successful due to poor performance and erosion from the liquid centrifuging outward. Attempts to use positive displacement machines have not been, successful due to high cost and size and reliability issues.

Another requirement for expanders, to improve the efficiency of a refrigeration system, is a cost effective method to use the generated shaft power.

SUMMARY OF INVENTION

A primary objective of the invention is to provide an efficient, cost effective method of recovering energy in a process where a gas is expanded from the supercritical region into the wet region of the cycle. Another important objective is to provide an efficient, cost effective means and method to utilize the power generated by the above expansion to reduce the power required by the process, for example by a compressor in a refrigeration cycle.

Another object is to provide a method of operating an axial flow turbine having rotor blades rotating about an axis, employing a working fluid capable of two-phase flow, that includes:

a) vaporizing said fluid b) compressing the vaporized fluid to a supercritical state, c) cooling the compressed vaporized fluid while maintaining it in said supercritical state, d) providing and operating a nozzle to receive and expand the compressed vaporized fluid to a pressure and temperature in the wet region of the cycle characterized by formation of liquid phase fluid droplets in the two-phase flow from the nozzle, e) directing that two-phase flow toward the turbine blades whereby the flow is turned in the spaces between the blades and directed to flow axially of the turbine rotor as well as outwardly away from its axis, producing a swirl of the flow leaving the blades, which typically reduces, and operable to produce torque transferable to the rotor, and to act in the direction of rotor rotation.

f) and subsequently vaporizing said flow that leaves the blades pursuant to step a).

A further objective is to provide a turbine that comprises:

a) an expansion nozzle contoured to expand the high pressure, supercritical fluid to a lower pressure in the wet region, producing a high velocity directed flow of gas and sub-micron liquid droplets or of supersaturated gas, b) axial flow blades, attached to a rotor, directed to receive the high velocity flow and turn it, generating torque acting on the rotor, c) surfaces oriented to receive liquid from the turned flow and direct it away from the moving (rotating) rotor, d) an exit duct to remove the gas and liquid flow from the flow directing surfaces and moving rotor, e) and a shaft coupled to the rotor to transfer generated torque to a load.

An additional objective is to provide an assembly consisting of the above turbine elements and a load that includes a compressor to increase the pressure of a gas whereby power for the compressor is provided at least in part by the power generated by the turbine.

Yet another objective is to use the above assembly to increase the pressure of the flow leaving the turbine, after the liquid is evaporated in a refrigeration system or heat pump, thereby reducing the power required by the main compressor for the system.

These and other objects and advantages of the invention, as well as the details of an illustrative embodiment, will be more fully understood from the following specification and drawings, in which:

DRAWING DESCRIPTION

FIG. 4 is a section taken through the transcritical turbine and boost compressor;

DETAILED DESCRIPTION

Figure 1:
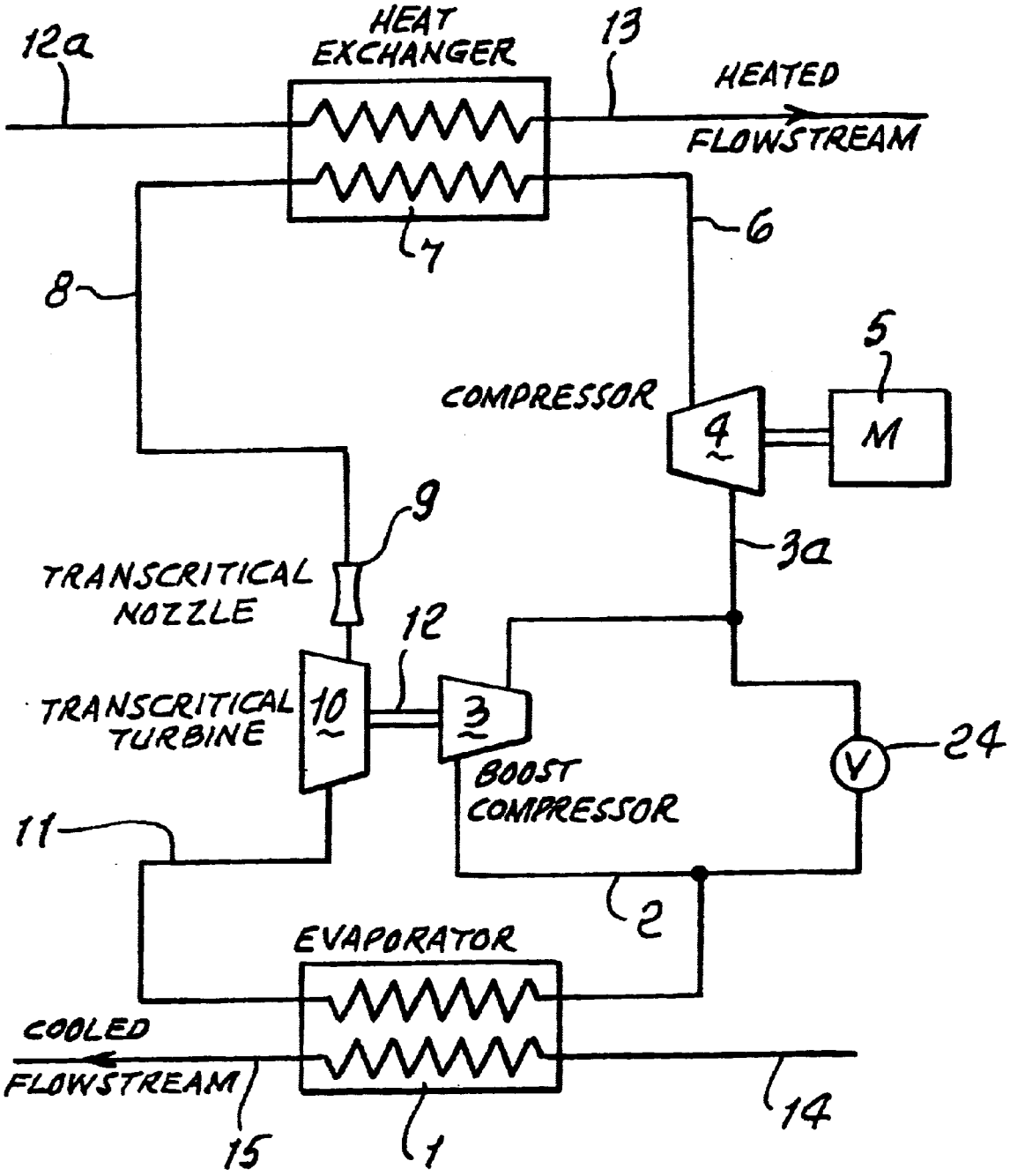
FIG. 1 is a schematic of supercritical refrigeration cycle with transcritical turbine.

FIG. 1 is a schematic diagram of a preferred refrigeration and heat pump process or system utilizing a transcritical turbine (TCT). The fluid is vaporized in an evaporator at 1. The gas leaving the evaporator at 2, is compressed in a compressor at 3, to a higher pressure indicated at 3*a*. The gas is further compressed by a main compressor 4 to a higher pressure shown at 6. The main compressor is driven by a motor or other prime mover 5.

The compressed gas 6 is in the supercritical region, i.e., having a temperature and temperature above the vapor dome for the substance. The supercritical gas is cooled in a heat exchanger 7 to conditions at 8, which are also supercritical. The cooled supercritical gas is expanded in the nozzle 9 of the transcritical turbine to a pressure and temperature in the wet region of the fluid. The high velocity fluid leaving the nozzle drives the transcritical turbine 10 producing power that drives a shaft 12. The fluid leaving the TCT at 11 enters the evaporator 1 where the liquid portion of the fluid is evaporated.

The heat source to evaporate the liquid can be a liquid or gas stream 14 to be cooled (refrigeration system), or a liquid or gas stream that is a source of heat to be raised in temperature (heat pump system). Similarly, the heat sink to cool the supercritical flow stream flowing via heat exchanger 7 from 6 to 8, can be a liquid or gas stream 12*a*, whose function is to remove and dissipate heat (refrigeration system), or which is to be heated (heat pump system).

An electric generator can be substituted for the compressor 3, and the flow 2 routed directly to the main compressor 4 as via valve 24. In this case the power generated by the electric generator can be used to reduce the electrical power required by the main compressor if it is driven by an electric motor also indicated at 5.

Figure 3:
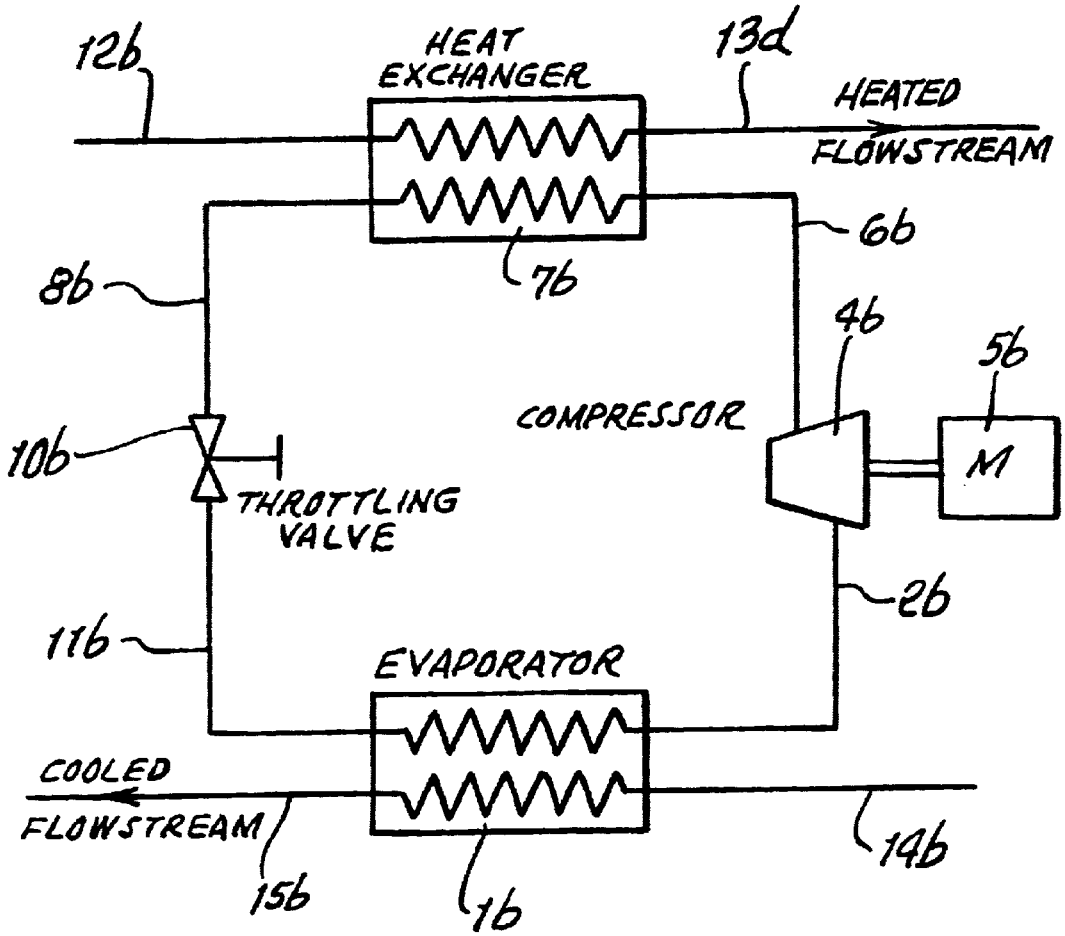
FIG. 3. PRIOR ART
FIG. 3 is a schematic of supercritical. refrigeration cycle with throttling valve.
Figure 9:
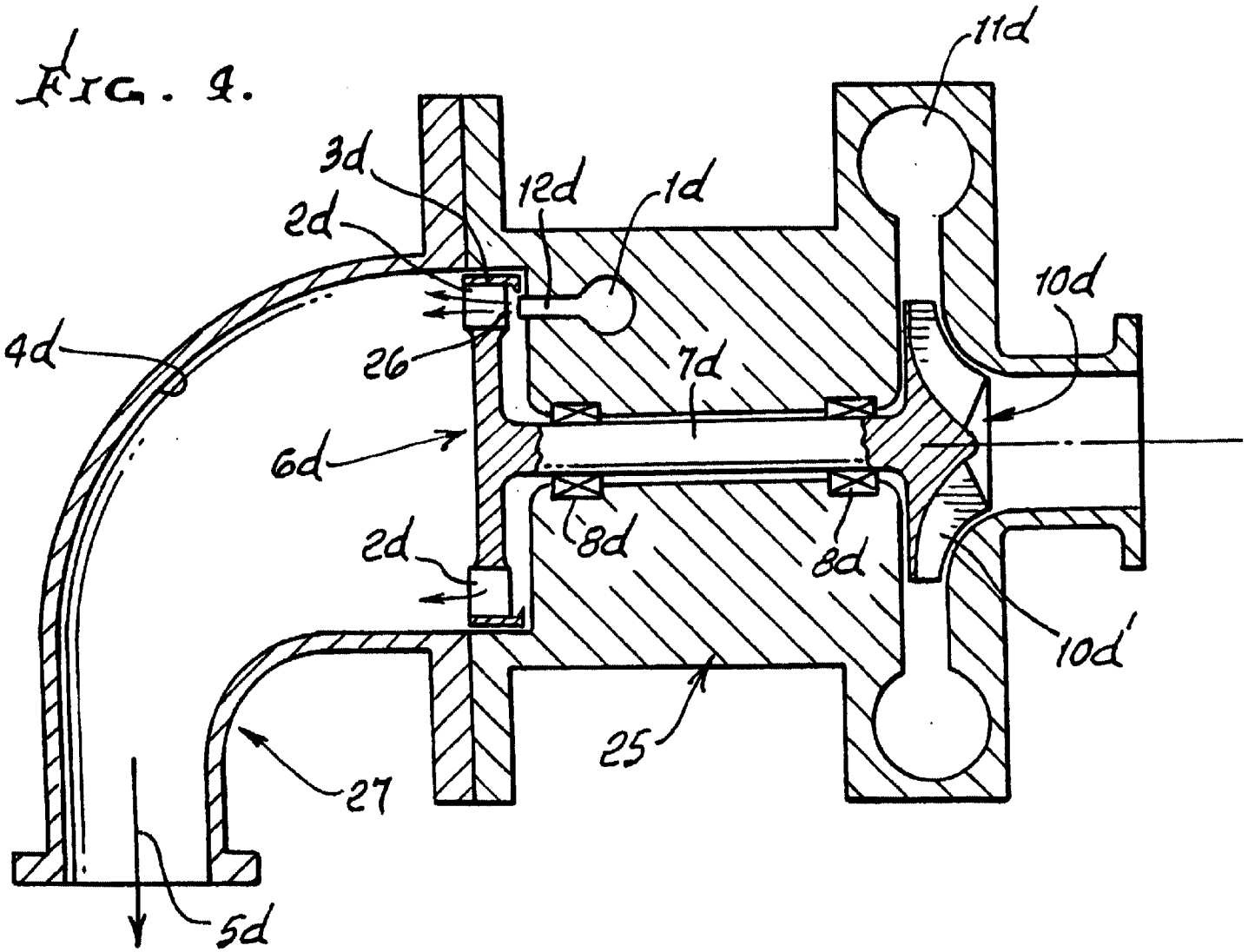

A conventional refrigeration or heat pump process is shown for comparison in FIG. 3. Fluid is vaporized in an evaporator 1*b*. The gas produced, indicated at 2*b* flows into the compressor 4*b*, and is compressed to a higher pressure at 6*b*. The main compressor is driven by a motor or other prime mover, 5*b*.

The compressed gas 6*b* is in the supercritical region, i.e., having a temperature above the vapor dome for the substance. The supercritical gas is cooled in a heat exchanger 7*b*, to conditions at 8*b* which are also supercritical. The cooled supercritical gas is expanded in a throttling valve 10*b* to a pressure and temperature in the wet region of the fluid. The fluid leaving the throttling valve at 11*b*, enters the evaporator 1*b*, where the liquid portion of the fluid is evaporated.

Figure 2:
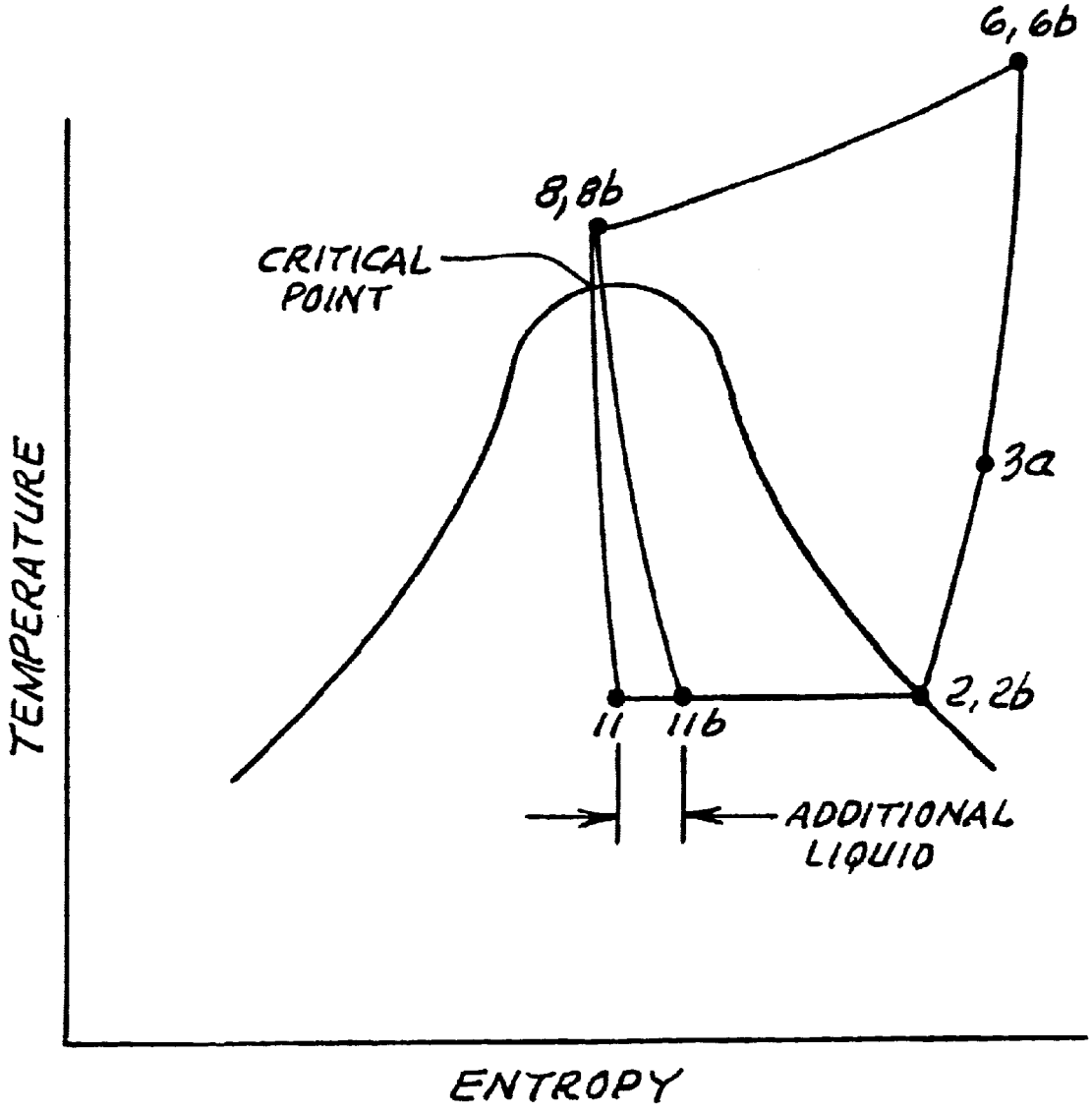
FIG. 2 is a temperature entropy diagram for transcritical refrigeration cycle.

The improvement provided by the TCT is illustrated by FIG. 2, a temperature entropy diagram for the processes. The numbers correspond to the conditions in FIG. 1 and FIG. 3. In both processes the gas is compressed to a point in the supercritical region 6 and 6*b*, and is cooled to a point 8 and 8*b*, in the supercritical region. However the power generated by the TCT increases the gas pressure to point 3*a*. The power required by the main compressor is then decreased since it only needs to increase the pressure from 3*a* to 6, whereas the throttling valve process requires the compressor to increase the pressure form 2*b* to 6*b*. In addition, since the expansion through the TCT is nearly isentropic, more liquid, as shown, is produced than in the throttling valve process. Thus, more cooling is also produced.

The TCT is shown in FIG. 4. Supercritical working fluid such as $CO_2$ from the heat rejection heat exchanger enters a volute 1*d*, which supplies one or more transcritical nozzles 12*d* in body structure 25. The fluid is expanded in the nozzle or nozzles forming a two-phase mixture jetting at 26, at high velocity. The flow is directed on the axial flow blades 2*d*, transferring energy to the rotor 6*d*. The flow swirls from the blades and from a blade shroud 3*d*, the liquid being collected on the outlet pipe walls 4*d*, as the flow is turned. The cooled two-phase mixture at 5*d* leaves through a vertical elbow 27 and flows to the evaporator as via path 11 seen in FIG. 1.

The rotor power drives a boost compressor rotor 10*d* which may be on the same shaft 7*d*. The shaft and rotors 6*d* and 10*d* may be supported by bearings 8*d* such as gas bearings, antifriction bearings or magnetic bearings associated with body structure 25. The full flow from the evaporator enters the turbine rotor driven boost compressor 10*d* as via path 2 seen in FIG. 1. The pressure is boosted by impeller blades 10*d*' to a value at collection ring 11*d* above the evaporator pressure, reducing the power requirements of the main compressor. Reduction of the pressure ratio required for the main compressor has the secondary benefit of increasing the main compressor efficiency. The unit is typically hermetically sealed, and readily manufactured using castings.

This method has the potential for the lowest or very low manufacturing cost and highest or very high reliability, for smaller systems. A second option is the generation of electric power from the expansion, which can be used to reduce the net power to the compressor. Recent advances in high speed i.e. high angular velocity generators can make this option useful for larger systems. Typical angular velocity exceeds 90,000 RPM.

Figure 5:
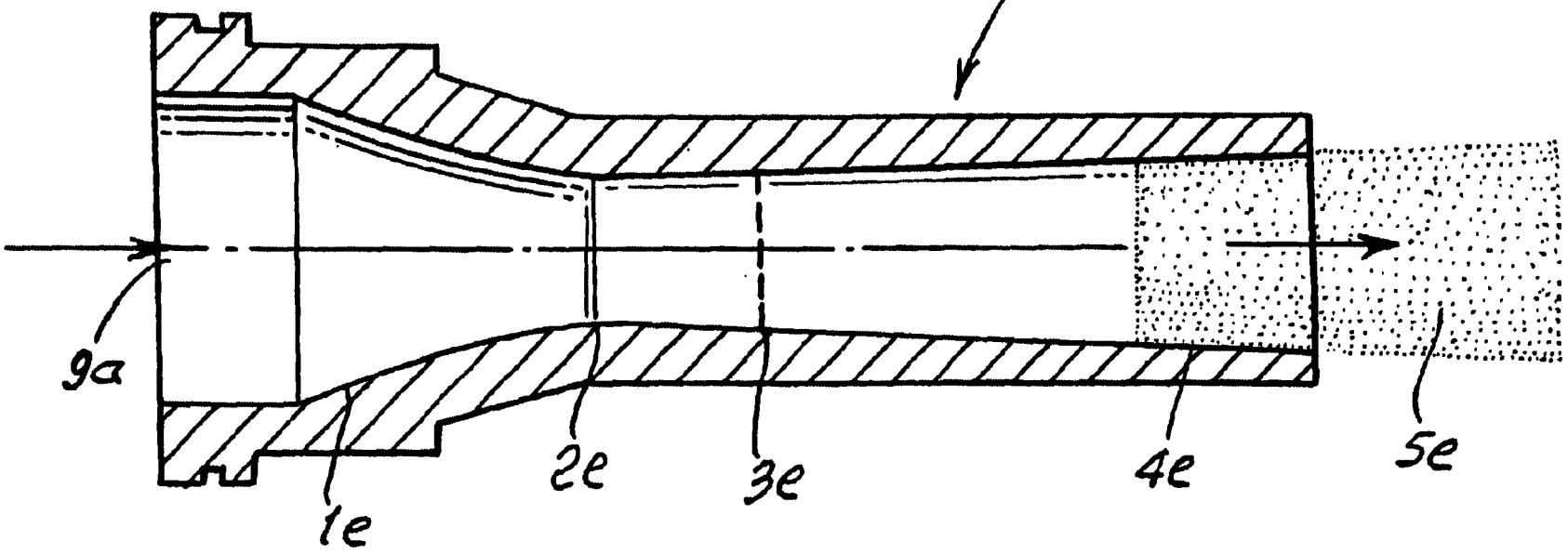
FIG. 5 is a section taken through a transcritical nozzle.

FIG. 5 shows a nozzle corresponding to nozzle 9 designed to expand the flow from supercritical conditions into the wet region. The supercritical fluid enters the nozzle at 9*a* at high pressure and low velocity, as at 1*e*.

The flow is to be expanded, typically, to supersonic velocities. A convergent section at 1*e* is followed by a minimum area throat 2*e*, from which the flow is expanded at 3*e* to a pressure at which liquid would form under equilibrium conditions. However, due to particle nucleation delay, further expansion occurs at 4*e* to a lower pressure, at which spontaneous condensations occur. The bulk of the droplets produced are very small, typically less than one micron ($10^{-6}$ meters) in diameter or cross section. The two-phase mixture continues to be accelerated until the exit pressure of the nozzle is reached, forming a high velocity jet at 5*e*.

Depending upon the expansion pressure and length of the nozzle, the flow may leave the nozzle in the supersaturated condition as a gas, and reversion to form liquid droplets may occur after the flow leaves the nozzle. In either case the function of the nozzle is to convert the enthalpy of the supercritical gas to kinetic energy and to cause the formation of the liquid phase in the form of extremely small droplets which increases the efficiency of converting the kinetic energy to shaft power, in TCT 10.

Figure 6:
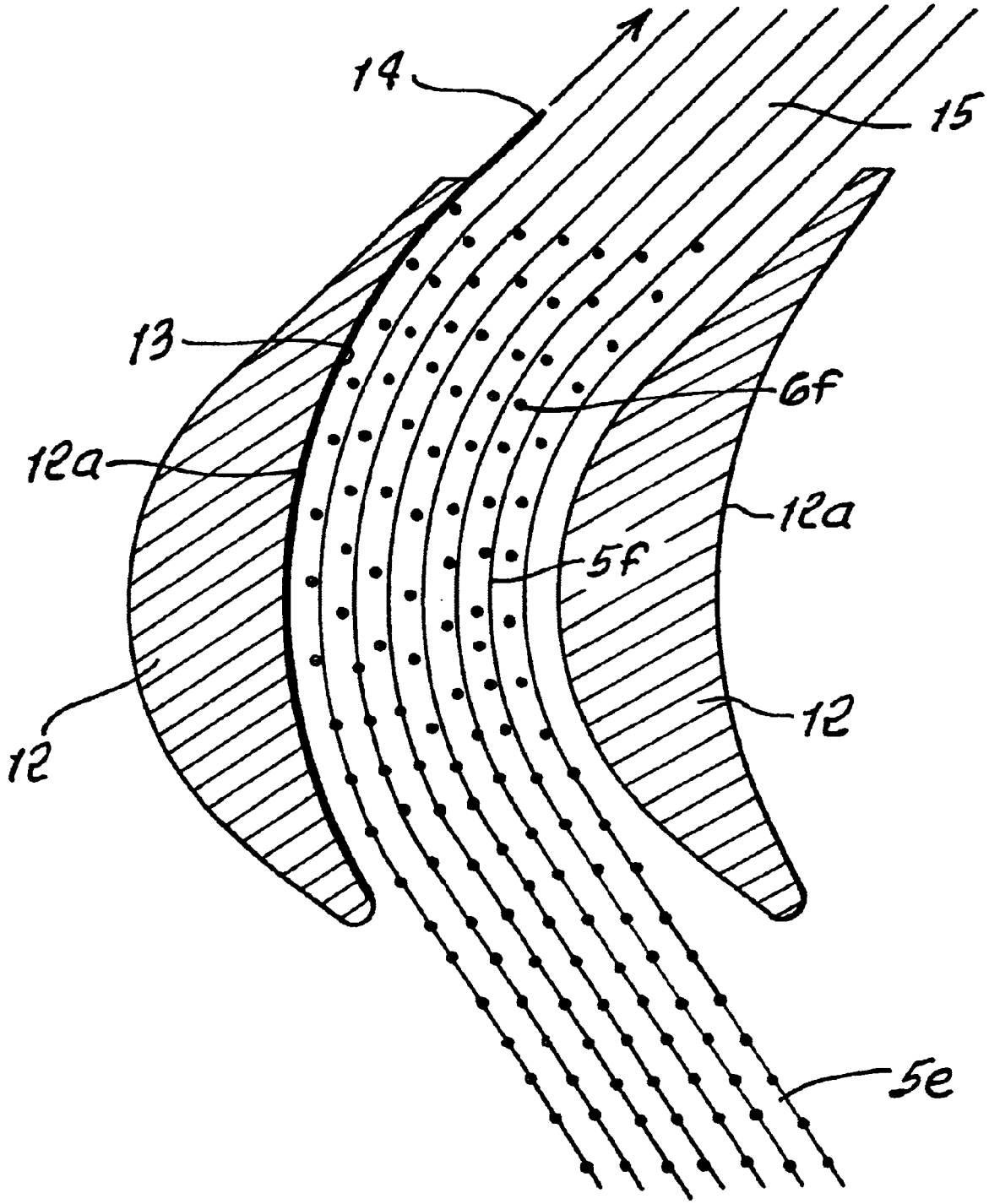
FIG. 6 is an enlarged fragmentary section taken through turbine impulse blades, and fluid flow paths.

In FIG. 6 a cross section of the TCT blades 12 is provided. The jet 5*e* from the transcritical nozzle impinges upon concave surfaces 12*a* of axial flow turbine blades 12. A fraction of the liquid droplets is centrifuged onto the blade by the angular turning of the flow, at 5*f* forming a liquid layer 13 on 12*a*. Most of the small droplets 6*f* are turned with the bulk flow, transferring their energy through the gas flow to the blades. Separated liquid layer 13 leaves the blade at 14 with a decreased relative velocity due to the high friction loss from a liquid film. The gas flow is turned, flowing generally parallel at 15, to the blade surface. The liquid droplets are centrifuged slightly towards the blades, transferring force to the gas which is transmitted to the blades. The largest fraction of the liquid droplets 6*f*, are turned and leave the axial turbine blade with a much smaller friction loss than the liquid collected by the blade.

A key feature of the impulse turbine design is the provision of an axial path (i.e. in a direction or directions having an axial component or components parallel to the turbine rotor axis) for the two-phase flow. As discussed previously, prior radial inflow turbine machinery will centrifuge liquid in a direction counter to the flow. This liquid can collect between the nozzles and rotor blades producing severe erosion. In the axial design of the TCT, the bulk of the liquid leaves the rotor with a swirl path extending about and lengthwise of the turbine axis to enable collection on the casing wall. The small fraction that is centrifuged toward blade tips is collected on a shroud surrounding the blade tips as at 3*d* in FIG. 4, the shroud also directing the flow to the case wall.

The advantages of a transcritical turbine refrigeration cycle using carbon dioxide as the working fluid are illustrated below. For purpose of the analysis and in an example, the heat exchanger outlet conditions were selected to be:

$T_1$=104 F $p_1$=1400 psia m=1440 lb/hr (where "m" is mass flow rate).

The expansion conditions chosen were:

$p_2$=525 psia $T_2$=34.7 F

A transcritical nozzle efficiency of 94% gives a spouting velocity of:

$V_b$=562 ft/s

The liquid fraction at the exit of the nozzle $1-x_2$=0.552 (where $x_2$ is the gas fraction at the exit of the nozzle).

The nozzle exit diameter is:

$$d_2=(1.27\ m/\rho_{2m}V_b)^{1/2}=0.102\ \text{inch}$$

where $\rho_{2m}$ is the density of the mixture and $\gamma_b$ is nozzle exit velocity.

The axial rotor diameter and speed will depend upon the characteristics of the compressor wheel it is driving. For purposes of this illustration a speed of 110,000 rpm. is selected. The rotor diameter is 0.6 in. at the mean line. The outer diameter is 0.9 in.

Analysis of the turbine, assuming 100% of the liquid is collected on the blades gives a power of 1952 watts at a net rotor efficiency of 74%. The net turbine efficiency considering the nozzle efficiency is 69%.

Assuming an isentropic compressor efficiency of 80%, the power from the TCT, 4.64 Btu/lb, results in a pressure boost of the full vapor flowrate to 665 psia. The enthalpy at this point is 189.94 Btu/lb, the temperature is 66 F and the entropy is 0.4417 Btu/lbdegR.

The main compressor power (for 80% isentropic efficiency) required to increase the boost pressure of 665 psia to 1400 psia is 16.70 Btu/lb.

For the prior flash valve expansion, the main compressor power required to increase the pressure from the 525 psia evaporator pressure 20.88 Btu/lb.

The liquid fraction leaving the TCT unit is greater than that leaving the flash valve due to the energy removed from the process. The liquid fraction was calculated for the TCT to be 0.5348. The liquid fraction leaving the flash valve was calculated to be 0.4873. The increase in cooling capacity for the evaporator is 1.098.

Thus the increase in cooling per unit of power input is:

$$\Delta COP/COP=(1.098)(20.88/16.70)=1.37,$$

where COP=coefficient o performance, Btu/kwhr

The above example provides approximately 6 ton of cooling. Increasing the size will improve the performance of the TCT because of partial admission effects and the decrease in the ratio of windage loss to shaft power output. The increase in COP will vary depending on the final cycle conditions. However, the above increase is significant and representative of the cycle efficiency advantages that can be realized with a transcritical $CO_2$ turbine and boost compressor utilized in place of the expansion valve.

Working fluid may include one or more of the following:

$CO_2$ isobutene propane butane ammonia

I claim:

1. A process employing a rotary axial turbine having rotor blades, and a nozzle, that includes a) providing a working fluid expansible from a characteristic supercritical region into the wet region, b) expanding said fluid from said supercritical region into said wet region via said nozzle and turbine blades, c) and providing an output shaft driven by the turbine, d) the nozzle operated to produce condensation droplets, e) and collecting a substantial fraction of the said condensation droplets on the axial flow structure of the turbine, said structure including concave blade surfaces and a shroud extending about tips defined by the blades, the bulk of the liquid leaving the turbine rotor with a swirl path extending about and lengthwise of the turbine axis.

2. The process of claim 1 which is employed in a refrigeration system.

3. The process of claim 1 which is employed in a heat pump system.

4. The process of claim 1 including providing a compressor operating to compress said fluid prior to said expanding, the compressor receiving rotary input via said shaft.

5. The process of claim 4 wherein the compressor is operated to increase the working fluid pressure, thereby reducing the power required to increase the working fluid pressure in a subsequent compression stage, prior to said expanding.

6. The process of claim 1 including directing a stream of liquid formed by said collected droplets away from the axial turbine structure so as to avoid a second contact with said structure that would otherwise result in energy losses.

7. The process of claim 1 including providing an electric generator driven by said shaft.

8. The process of claim 1 wherein the working fluid includes carbon dioxide.

9. The process of claim 1 wherein the working fluid includes one of the following:

a) isobutane b) propane c) butane d) ammonia.

10. The method of operating an axial flow turbine having rotor blades rotating at high velocity about an axis, and employing a working fluid capable of two-phase flow, that includes a) vaporizing said fluid b) compressing said vaporized fluid to a supercritical state, in a turbine driven boost compressor stage and in a subsequent main, compressor stage, c) cooling the compressed vaporized fluid while maintaining it in said supercritical state, d) providing and operating a nozzle to receive and expand said compressed vaporized fluid to a pressure and temperature in the wet region of the fluid characterized by formation of liquid phase droplets of the fluid in a two-phase flow from the nozzle, the bulk of the droplets being less than 1 micron in cross section, e) directing said two-phase flow toward the turbine blades whereby the flow is turned in the spaces between the blades and directed to flow axially of the turbine rotor as well as outwardly away from said axis, reducing the swirl of the flow leaving the blades, and operable to produce torque transferable to the rotor to act in the direction of rotor rotation, f) and subsequently vaporizing said flow that leaves the blades pursuant to step a).

11. The method of claim 10 wherein said fluid consists of one or more of the following:

i) carbon dioxide ii) isobutane iii) propane iv) butane v) ammonia.

12. The method of claim 10 including providing a shroud to extend about said blades and against which a portion of the flow is centrifuged.

13. The method of claim 10 including providing an evaporator in which said step a) is carried out, and providing an auxiliary liquid or gas stream passed to the evaporator to transfer heat to the working fluid for evaporating same.

14. The method of claim 10 including providing a heat exchanger in which said step c) is carried out, and providing an auxiliary liquid or gas stream passed to the heat exchanger to cool the compressed working fluid also passed to the heat exchanger.

15. The method of claim 13 including providing a heat exchanger in which said step c) is carried out, and providing an auxiliary liquid or gas stream passed to the heat exchanger to cool the compressed working fluid also passed to the heat exchanger.

16. An axial flow turbine with rotor blades to receive a two-phase flow of fluid, that comprises:

a) an expansion nozzle contoured to expand the high pressure, supercritical fluid to a lower pressure in the wet region, producing a high velocity directed flow of gas and sub-micron liquid droplets, or of supersaturated b) axial flow blades, attached to a rotor, directed to receive the high velocity flow and turn it, generating torque on the rotor, c) surfaces oriented to receive liquid from the turned flow and direct it away from the moving rotor, d) an exit duct to remove the gas and liquid flow from surfaces and from the moving rotor, e) and a shaft attached to the rotor to transfer the generated torque to a load, f) the turbine rotor having an overall diameter less than 1.5 inches, and an operating angular velocity in excess of 90,000 RPM.

17. The turbine of claim 16 wherein the turbine has a stationary body within which said rotor and nozzles are located.

18. The turbine of claim 17 including a rotary compressor in said body and coupled to said shaft.

19. The process of claim 1 wherein the bulk of the droplets are in sub-micron size range, said droplets directed to flow with a fluid gas phase through the turbine transferring force to axial flow structure defined by the turbine.

* * * * *